US006536967B2

(12) United States Patent
Inoue

(10) Patent No.: US 6,536,967 B2
(45) Date of Patent: Mar. 25, 2003

(54) LINE PRINTER

(75) Inventor: Yoshimasa Inoue, Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/948,579

(22) Filed: Sep. 10, 2001

(65) Prior Publication Data

US 2002/0037190 A1 Mar. 28, 2002

(30) Foreign Application Priority Data

Sep. 11, 2000 (JP) ..... 2000-274457

(51) Int. Cl.[7] ..... B41J 11/42

(52) U.S. Cl. ..... 400/582; 347/12; 347/19; 347/42

(58) Field of Search ..... 400/582, 62, 73, 400/76, 120.05, 120.06, 120.07; 347/42, 12, 19, 105, 106, 180, 182, 16, 40

(56) References Cited

U.S. PATENT DOCUMENTS 5,226,742 A * 7/1993 Pintar et al. ..... 400/583.4
5,674,014 A * 10/1997 Jordan ..... 400/124.02
6,315,390 B1 * 11/2001 Fujii et al. ..... 347/42

FOREIGN PATENT DOCUMENTS

JP 02-258355 * 10/1990 ..... B41J/2/36
JP 04-357048 * 12/1992 ..... B41J/2/30
JP 07-329335 * 12/1995 ..... B41J/2/355
JP 08-252938 * 10/1996 ..... B41J/2/355
JP 2001-171863 * 6/2001 ..... B65H/7/00
JP 2002-086785 * 3/2002 ..... B41J/2/36

* cited by examiner

*Primary Examiner*—Andrew H. Hirshfeld
*Assistant Examiner*—Darius N. Cone
(74) *Attorney, Agent, or Firm*—Oblon, Spivak, McClelland, Maier & Neustadt, P.C.

(57) ABSTRACT

The present invention detects print data areas set in one-block units with white lines as boundaries, calculates division numbers for divisionally driving a line head every areas extending in its main scan direction to thereby output print data when the numbers of dots set every lines in the print data areas exceed the maximum number of printable dots set by a head drive unit, detects maximum division numbers n in the print data areas, sets paper feed velocities $V_1$ through $V_4$ in inverse proportion to the maximum division numbers n respectively, and executes printing in the print data areas set in the one-block units on the condition that the line head is divisionally driven with the maximum division numbers n and paper is fed at the set paper feed velocities $V_1$ through $V_4$. Thus, a reduction in power consumption can be satisfied. Since it is possible to increase a paper feed velocity in proportion as a print data area low in the number of dots in particular, the speeding up of printing can be achieved.

1 Claim, 5 Drawing Sheets

X1
X2
X3
X4

200DOTS
200DOTS
200DOTS
200DOTS

200DOTS
50DOTS
150DOTS
200DOTS

100DOTS
100DOTS
100DOTS
100DOTS

50DOTS
50DOTS
50DOTS
50DOTS

LINE PRINTER

CROSS REFERENCE TO RELATED APPLICATION

The present application is based on Japanese Priority Document 2000-274457 filed on Sep. 11, 2000, the content of which is incorporated herein by reference.

BACKGROUND OF THE INVENTION

1. Field of the Invention

The present invention relates to a line printer which performs printing by using a line head such as a thermal head, an ink jet head or the like.

2. Discussion of the Background

There has heretofore been known a proposal wherein in a line printer using a thermal head as in a facsimile or the like, the thermal head is driven divisionally in a main scan direction to thereby hold low, power consumption for driving the thermal head even when print data set every lines increase, whereby the capacity of a power supply is reduced. However, a problem arises in that since the thermal head is driven on a division basis even when print data (number of dots) set for each line decreases, a print velocity becomes slow.

With the foregoing in view, there has been a proposal wherein a division number for driving a thermal head is set according to the plentiness or degree of the number of dots to thereby achieve a reduction in power consumption and the speeding up of printing, as described in Japanese Patent Provisional Publication (Kokai) No. Hei 5(1993)-201053.

The proposal described in Japanese Patent Provisional Publication (Kokai) No. Hei 5(1993)-201053 is excellent in terms of the speeding up of the printing as compared with the proposals made prior to it. However, since a print velocity in a sub-scan direction, i.e., a paper feed velocity is constant even if a division number for divisionally driving the thermal head decreases or increases, there is a limit to the speeding up of the printing.

SUMMARY OF THE INVENTION

In certain embodiments, there is a line printer capable of satisfying a reduction in power consumption and achieving the speeding up of printing.

According to embodiments of the present invention, a printer detects print data areas set in one-block units with white lines as boundaries, calculates division numbers for divisionally driving a line head in every area, extending in its main scan direction to thereby output print data when the numbers of dots set in every line in the print data areas exceed the maximum number of printable dots set by a head drive unit, detects maximum division numbers in the print data areas, sets paper feed velocities in inverse proportion to the maximum division numbers respectively, and executes printing in the print data areas set in the one-block units on the condition that the line head is divisionally driven with the maximum division numbers and paper is conveyed at the set paper feed velocities.

BRIEF DESCRIPTION OF THE DRAWINGS

A more complete appreciation of the present invention and many of attendant advantages thereof will be readily obtained as the same becomes better understood by reference to the following detailed description when considered in connection with the accompanying drawings, wherein.

DETAILED DESCRIPTION OF THE PREFERRED EMBODIMENT

A first embodiment of the present invention is now explained with reference to FIGS. 1–5.

Figure 1:
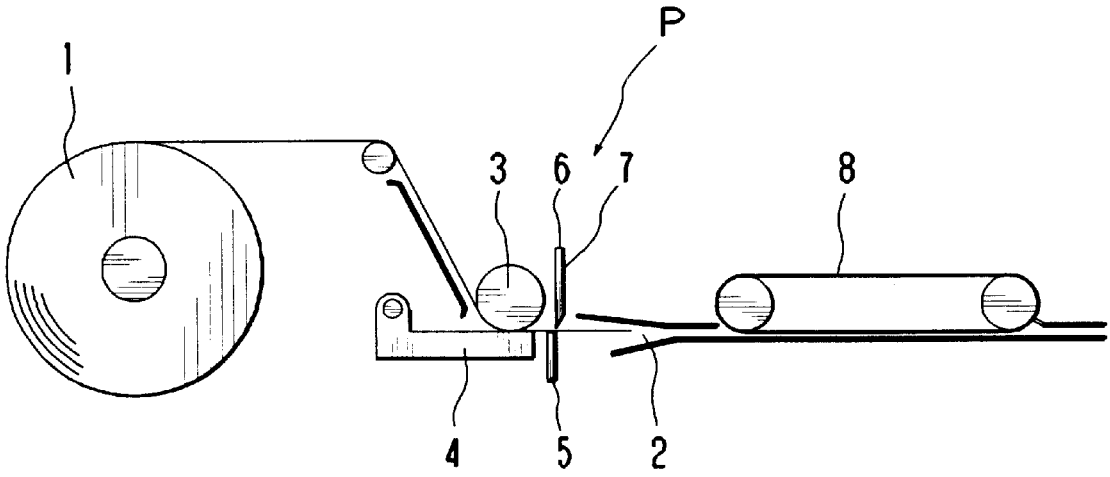
FIG. 1 is an explanatory diagram showing a schematic configuration of a line printer according to one embodiment of the present invention.
Figure 2:
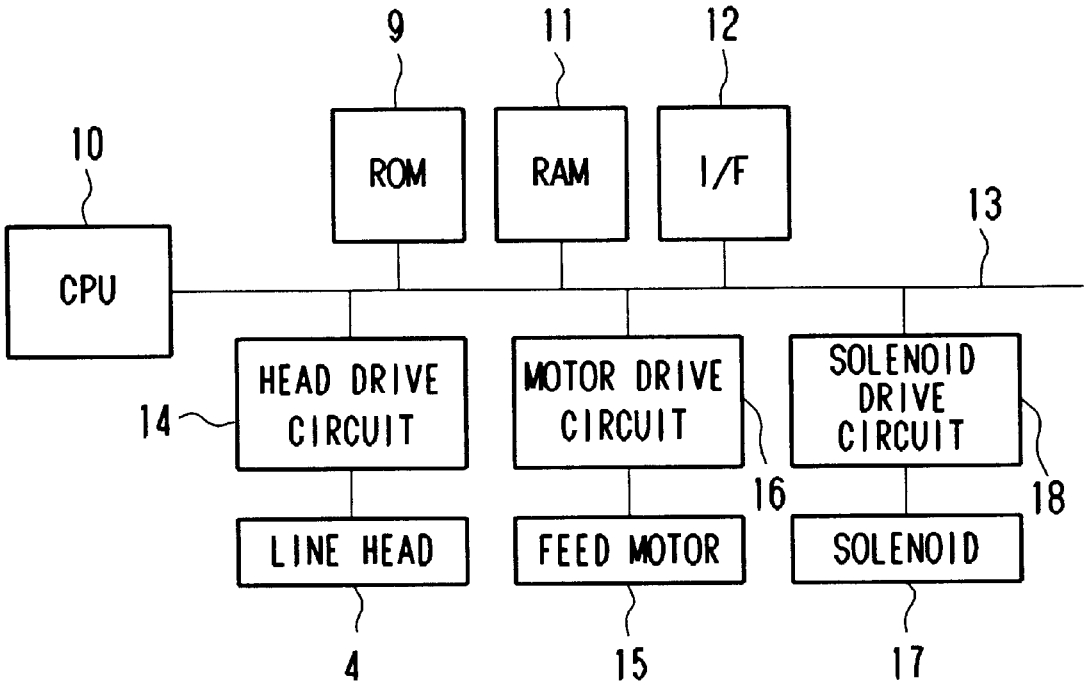
FIG. 2 is a block diagram illustrating electrical connections of the line printer.
Figures 3A, 3B, 3C, 3D:
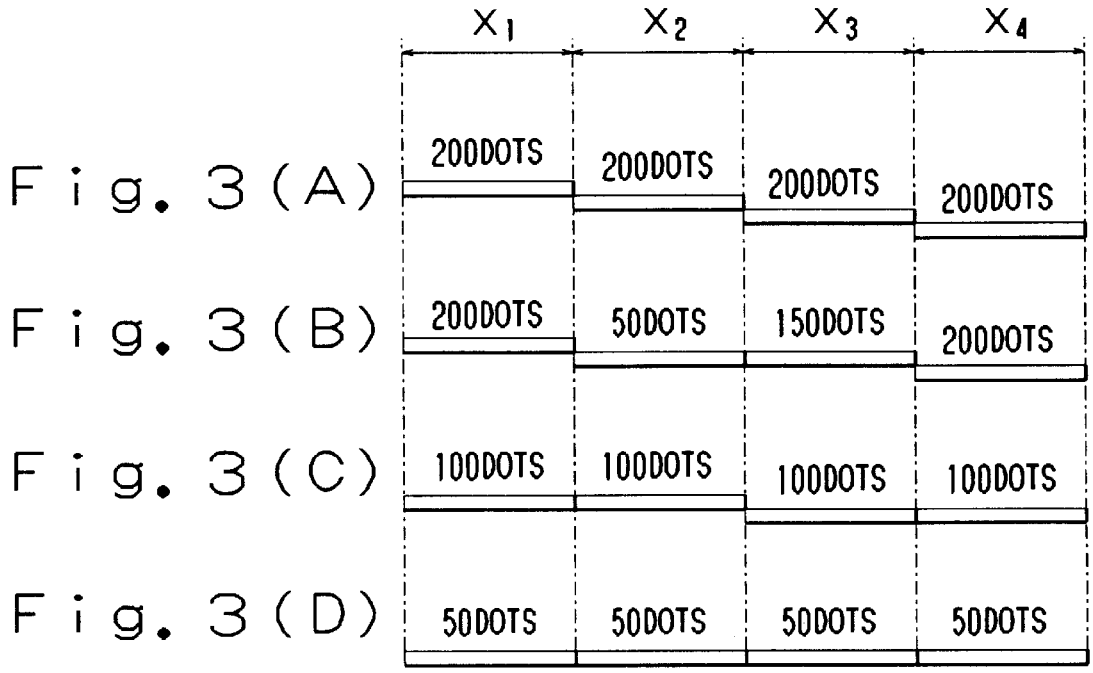
FIG. 3 is an explanatory diagram depicting drive forms of a line head.
Figure 4:
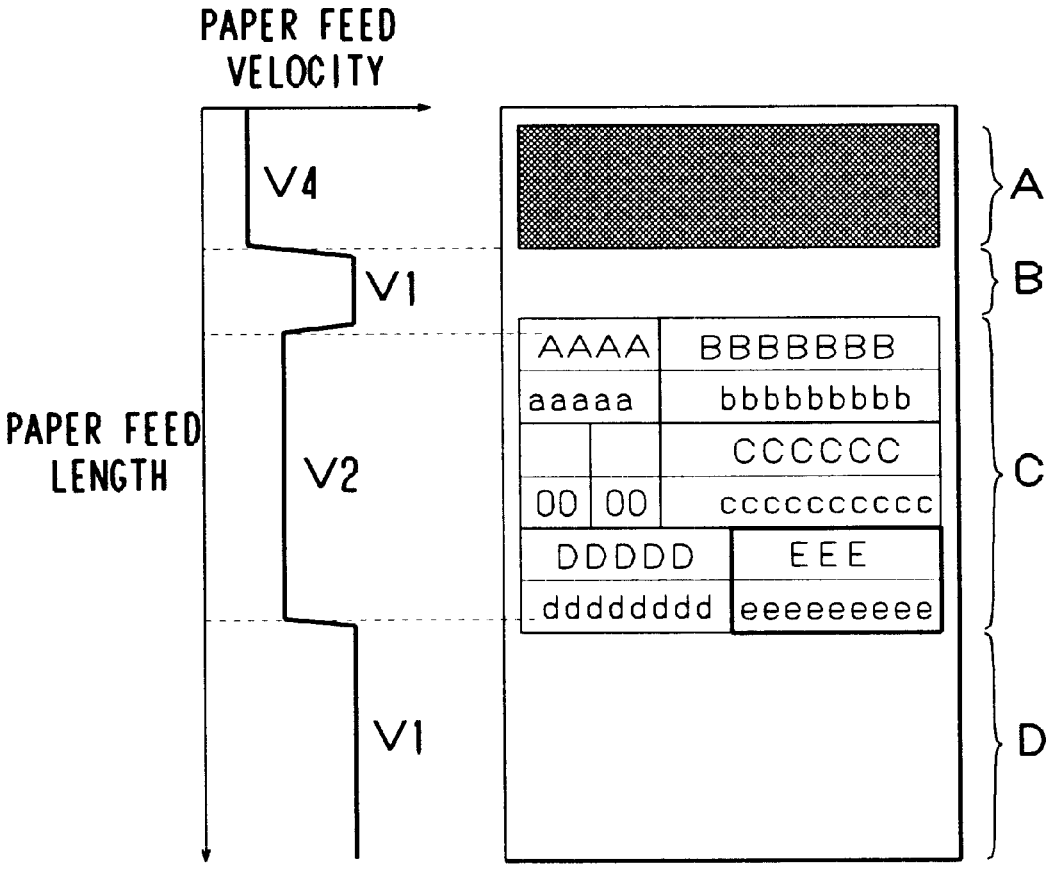
FIG. 4 is an explanatory diagram showing the relationship between a printed example and paper feed velocities thereat.
Figure 5:
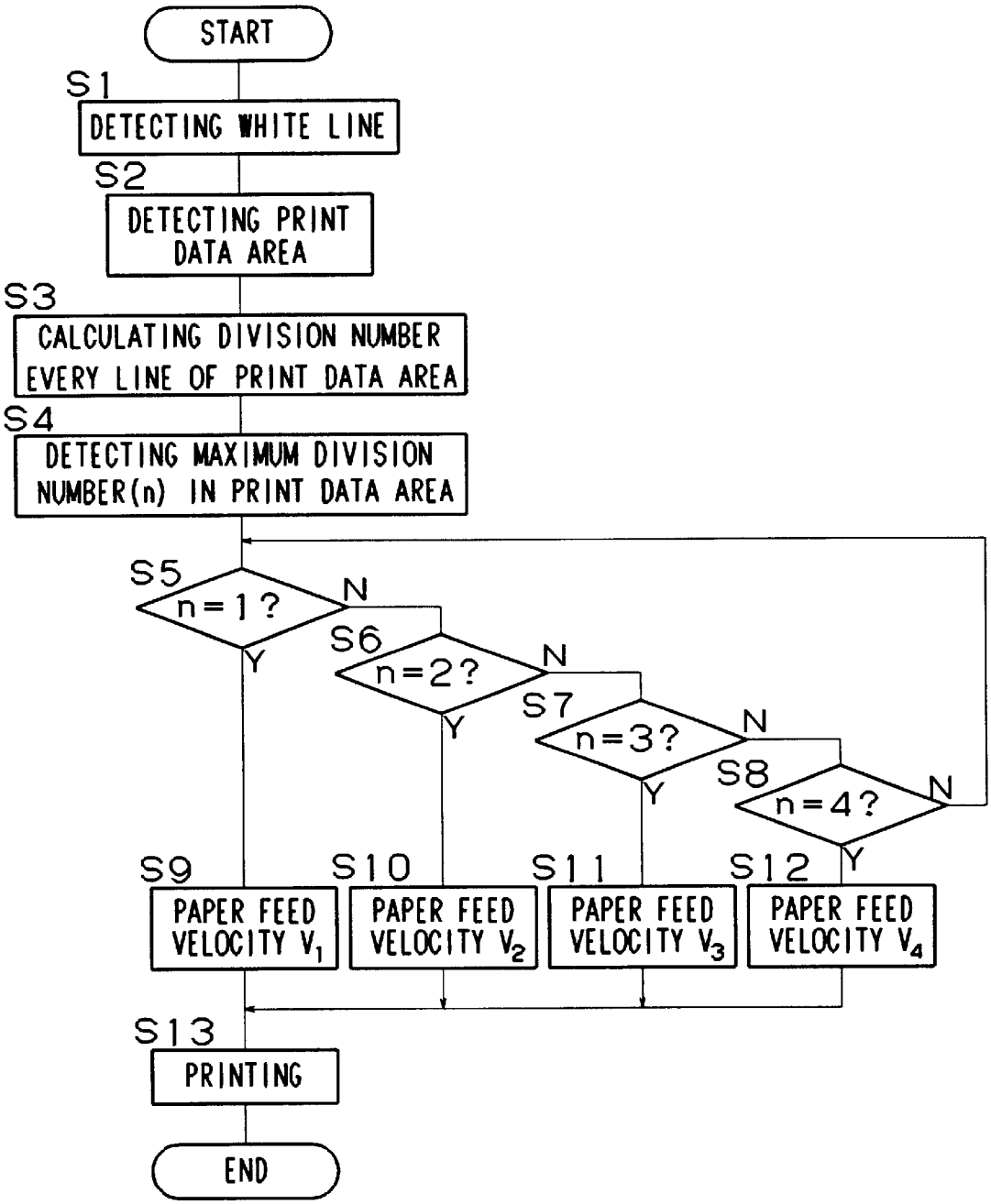
FIG. 5 is a flowchart illustrating a printing process.

FIG. 1 is an explanatory diagram showing a schematic configuration of a line printer, FIG. 2 is a block diagram illustrating an electrical connection structure of the line printer, FIG. 3 is an explanatory diagram depicting drive forms of a line head, FIG. 4 is an explanatory diagram showing the relationship between a printed example and paper feed velocities thereat, and FIG. 5 is a flowchart illustrating a printing process, respectively.

As shown in FIG. 1, the line printer P according to the present embodiment has a platen 3 and a line head 4 opposite to each other with a paper feed path 2 for guiding a roll paper 1 used as paper as the boundary. In the present example, the line head 4 is a thermal head wherein a number of heater elements are arranged along a main scan direction orthogonal to a direction (sub-scan direction) to feed the roll paper 1. As an alternative to it, however, an ink jet head wherein a number of nozzles are arranged in a main scan direction, may be used. A cutter 7 having a fixed blade 5 and a movable blade 6, and a conveyor belt 8 are sequentially arranged on the downstream side of the line head 4 in the paper feed path 2. Here, the platen 3 and the conveyor belt 8 function as paper feeding members respectively.

A description will next be made of an electrical connection structure of the line printer P with reference to FIG. 2. A ROM 9 in which fixed data such as a program or the like is written, a CPU 10 for monitoring operations of respective portions and executing each program, a RAM 11 which updatably stores variable data such as work data or the like, and an interface (I/F) 12 connected to an external circuit such as an upper device or the like are connected to one another by a system bus 13. Further, a head drive circuit 14 used as a drive unit for driving the line head 4, a motor drive circuit 16 used as a drive unit for driving a feed motor 15, and a solenoid drive circuit 18 for driving a solenoid 17 are connected to the CPU 10 through the system bus 13. Incidentally, input shafts (not shown) of the platen 3 and the conveyor belt 8 are coupled to the feed motor 15. While the movable blade 6 of the cutter 7 is driven by the solenoid 17 in the present embodiment, a motor (not shown) is used in place of the solenoid 17 and the rotation of the motor may be converted to linear motion to drive the movable blade 6.

In the present embodiment, the line head 4 is capable of printing up to 800 dots in one line. A power supply (not shown) of the line head 4 is set to such capacity that the number of once-maximum printable dots reaches up to 200.

In such a construction, the roll paper 1 is fed under the rotations of the platen 3 and the conveyor belt 8 and the line head 4 is driven in its feeding process to thereby perform printing. When predetermined print data is printed and the roll paper 1 is conveyed over a predetermined length, the movable blade 6 is driven by the solenoid 17. Therefore, the roll paper 1 is cut in units of forms or tags such as slips, and conveyed by the conveyor belt 8, so that it is issued from an end of the paper feed path 2.

Upon such printing, the head drive circuit 14 is capable of divisionally driving the line head 4 in regions extending in its main scan direction according to the plentiness of the number of dots in one line. $X_1$, $X_2$, $X_3$ and $X_4$ shown in FIG. 3 respectively show regions divided in the main scan direction of the line head 4.

Described specifically, when the numbers of dots in the respective regions designated at $X_1$, $X_2$, $X_3$ and $X_4$ are given as 200 as shown in FIG. 3(A), the numbers of dots are respectively equal to the maximum number of printable dots 200, and the line head 4 can be driven only in one region. Therefore, a division number for divisionally driving the line head 4 is defined as 4, and the line head 4 is driven four times in parts in order of the regions $X_1$, $X_2$, $X_3$ and $X_4$ by means of the head drive circuit 14.

When the numbers of dots in the regions designated at $X_1$, $X_2$, $X_3$ and $X_4$ are respectively given as 200, 50, 150 and 200 as shown in FIG. 3(B), the number of dots 200 in the region $X_1$ is equal to the maximum number of printable dots 200. Therefore, the region for driving the line head 4 in the first time is defined as $X_1$. Next, the number of dots 50 in the region $X_2$ and the maximum number of printable dots 200 are compared with each other. Since the present number of dots is smaller than the maximum number of printable dots 200 in this case, the number of dots 200 obtained by adding the number of dots 150 lying in the region $X_3$ to the number of dots 50 is compared with the maximum number of printable dots 200. Since they are equal to each other as a result of its comparison in this case, the regions for driving the line head 4 in the second time are defined as the two regions of $X_2+X_3$. Since the number of dots 200 in the next $X_4$ and the maximum number of printable dots 200 are equal to each other, the region for driving the line head 4 in the third time is defined as $X_4$.

When the numbers of dots in the respective regions designated at $X_1$, $X_2$, $X_3$ and $X_4$ are given as 100 as shown in FIG. 3 (C) , the number of dots 100 in the region $X_1$ and the maximum number of printable dots 200 are compared with each other. Since the present number of dots is smaller than the maximum number of printable dots 200 in this case, the number of dots 200 obtained by adding the number of dots 100 in the region $X_2$ to the number of dots 100 in the region $X_1$ is compared with the maximum number of printable dots 200. Since they are equal to each as a result of its comparison in this case, the regions for driving the line head 4 in the first time are defined as the two regions of $X_1+X_2$. Next, the number of dots 100 in the region $X_3$ and the maximum number of printable dots 200 are compared with each other. Since the present number of dots is smaller than the maximum number of printable dots 200 even in this case, the number of dots 200 obtained by adding the number of dots 100 lying in the region $X_4$ to the number of dots 100 is compared with the maximum number of printable dots 200. Since they are also equal to each other as a result of its comparison in this case, the regions for driving the line head 4 in the second time are defined as the two regions of $X_3+X_4$.

When the numbers of dots in the regions designated at $X_1$, $X_2$, $X_3$ and $X_4$ are respectively given as 50 as shown in FIG. 3(D), the number of dots 50 in the region $X_1$ and the maximum number of printable dots 200 are compared with each other. Since the present number of dots is smaller than the maximum number of printable dots 200 in this case, the number of dots 200 to be obtained by adding the number of dots 50 in the region $X_2$ to the number of dots 50 in the region $X_1$ is compared with the maximum number of printable dots 200. Since, however, the resultant number of dots is less than the maximum number of printable dots 200, the number of dots obtained by adding the numbers of dots in subsequent regions to both numbers of dots in order of $X_3$ and $X_4$ is compared with the maximum number of printable dots 200 until the resultant number of dots reaches the maximum number of printable dots 200. In the present example, the region for driving the line head 4 at one time without division is defined as all the regions of $X_1$, $X_2$, $X_3$ and $X_4$.

A specific example wherein a division number for divisionally driving the line head 4 according to the degree of the number of dots in one line in this way is changed to perform printing, will be explained based on FIGS. 4 and 5. The right side of FIG. 4 shows a printed example, and the left side thereof shows the relationship between a paper feed velocity (horizontal axis) and a paper feed length (vertical axis) by a time chart. The printed example shown on the right side of FIG. 4 is a tag or form such as a slip, which includes a print data area A highest in dot density as in the case of a logo mark, a non-print area B in which a white line runs or extends continuously, a print data area C relatively low in dot density as in the case of characters or the like, and a non-print area D in which a white line runs, as viewed in order from above.

When such print data is received, the line printer P performs a process shown in FIG. 5. Namely, when the received print data is stored in a memory such as the RAM 11, the line printer P detects white lines corresponding to non-print areas (S1), and detects print data areas (S2). The white lines detected in this case correspond to the non-print areas B and D shown in FIG. 4, and the print data areas correspond to the print data areas A and C shown in FIG. 4, respectively. Here, Step S1 realizes or achieves white line detecting means for detecting the white lines (non-print areas B and D) . Step S2 realizes print data area detecting means for detecting the print data areas A and C set in one-block units with the detected white lines as the boundaries.

Next, a method similar to the method described with reference to FIG. 3 is used to calculate division numbers for divisionally driving the line head 4 in every area extending in its main scan direction based on the result of comparison between the numbers of dots set in every line of the print data areas A and C in the detected one-block units and the maximum number of printable dots 200 set by the head drive circuit 14 and thereby outputting print data (S3). Since the print data area A is high in dot density in the example shown in FIG. 4, lines for driving the line head 4 on a four-division basis and four times in parts will be included in the areas of $X_1$, $X_2$, $X_3$ and $X_4$. Since the print data area C is relatively low in dot density, such lines that the line head 4 is capable of driving all the areas of $X_1$, $X_2$, $X_3$ and $X_4$ at a time, and lines for driving the line head 4 two times in parts in the form of two divisions of the two areas of $X_1+X_2$ and the two areas of $X_3+X_4$ are regarded as existent in mixed form. Step S3 referred to above realizes division number calculating means. The division numbers calculated in this way are temporarily stored in the RAM 11 or the like.

Next, a method such as retrieval of data about the division number for each line stored in the RAM 11 is used to detect the maximum division number n in each of the print data areas A and C set in one-block units (S4). In the example referred to above, the maximum division number n in the print data area A is 4 and the maximum division number n in the print data area C is 2. Step S4 referred to above realizes maximum division number detecting means.

Next, paper feed velocities (each corresponding to the number of revolutions of the feed motor 14) are set high by the motor drive circuit 16 in inverse proportion to the detected maximum division numbers n respectively (S5 through S12). Steps S5 through S12 referred to above realize paper feed velocity setting means. Namely, when n=1 (Y of S5) , the paper feed velocity is set to $V_1$ (S9). When n=2 (Y of S6), the paper feed velocity is set to $V_2$ (S10). When n=3 (Y of S5), the paper feed velocity is set to $V_3$ (S11). When n=4 (Y of S5), the paper feed velocity is set to $V_4$ (S12). The paper feed velocity satisfies the relation in $V_1 > V_2 > V_3 > V_4$, and the product of the division number and the paper feed velocity is constant.

In the present example, the paper feed velocity used upon printing is of the slowest $V_4$ because the print data area A high in dot density is n=4. Further, since the print data area C relatively low in dot density is n=2, the paper feed velocity used upon printing is a relatively fast $V_2$. Since, in this case, n=1 means that it is not necessary to drive the line head 4 on a division basis, the paper feed velocity for the white line (corresponding to each of the non-print areas B and D) is of the fastest $V_1$.

Next, the head drive circuit 14 and the motor drive circuit 16 are operated with the detected maximum division numbers n and the set paper feed velocities $V_1$, $V_2$, $V_3$ and $V_4$ as conditions to thereby allow the line head 4 to perform printing while feeding the roll paper 1 (S13). The present Step S13 realizes printing executing means.

Thus, the line head 4 is divisionally driven with the division numbers corresponding to the dot densities of the print data areas A and C to thereby make it possible to meet a reduction in power consumption. Further, since the paper feed velocity can be set high as $V_2$ in proportion as the print data area C low in dot density, a further speeding-up of printing can be achieved. Since the roll paper 1 can be conveyed at the fastest paper feed velocity $V_1$ in the white lines (non-print areas B and C), a print velocity can be set faster.

Further, the print data areas A and C respectively set in one-block units are different from each other in terms of the division numbers for driving the line head 4 on a division basis according to the lines. However, since the line head 4 is divisionally driven with the maximum division number adapted to each of lines most increased in the number of dots if the same block is taken, and the roll paper 1 is conveyed at a paper feed velocity unified to the maximum division number, a clean or good-looking print result can be obtained.

Incidentally, while the maximum division number n of the line head 4 has been set to 4, n is not limited to 4. Further, the number of dots in which the line head 4 can be driven at a time, is not limited to 200.

Obviously, numerous modifications and variations of the present invention are possible in light of the above teachings. It is therefore to be understood that within the scope of the appended claims, the invention may be practiced otherwise than as specifically described herein.

What is claimed is:

1. A line printer, comprising:

a feed drive unit for driving a paper feeding member;

a head drive unit for driving a line head disposed along a main scan direction orthogonal to a paper feeding direction;

white line detecting means for detecting each of white lines which serve as non-print areas;

print data area detecting means for detecting print data areas set in one-block units with the detected white lines as boundaries;

division number calculating means for calculating division numbers for divisionally driving the line head in every area extending in its main scan direction, based on the result of comparison between the numbers of dots set in every line of the print data areas in the detected one-block units and a maximum number of printable dots set by the head drive unit and outputting print data therefrom;

maximum division number detecting means for detecting maximum division numbers in the print data areas set in the one-block units;

paper feed velocity setting means for setting paper feed velocities by the feed drive unit in inverse proportion to the detected maximum division numbers; and printing executing means for operating the head drive unit and the feed drive unit under the condition of the detected maximum division numbers and the set paper feed velocities to thereby execute printing.

* * * * *